United States Patent [19]

Corcoran et al.

[11] Patent Number: 4,666,053

[45] Date of Patent: May 19, 1987

[54] TAMPER-INDICATING PLASTIC CLOSURE

[75] Inventors: Michael E. Corcoran; John Schetzsle, both of Crawfordsville, Ind.; James Stopher, Woodstock, Ga.

[73] Assignee: H-C Industries, Inc., Crawfordsville, Ind.

[21] Appl. No.: 824,428

[22] Filed: Jan. 31, 1986

[51] Int. Cl.[4] ..... B65D 41/34

[52] U.S. Cl. ..... 215/252

[58] Field of Search ..... 215/252

[56] References Cited

U.S. PATENT DOCUMENTS 4,418,828 12/1983 Wilde et al. ..... 215/252
4,497,765 2/1985 Wilde et al. ..... 215/252 X
4,573,601 3/1986 Berglund ..... 215/252

FOREIGN PATENT DOCUMENTS 628172 11/1961 Italy ..... 215/252

*Primary Examiner*—Donald F. Norton
*Attorney, Agent, or Firm*—Dressler, Goldsmith, Shore, Sutker & Milnamow, Ltd.

[57] ABSTRACT

A tamper-indicating plastic closure construction is disclosed which includes an annular pilfer band which depends from an annular skirt portion of the closure. The pilfer band is partially detachably connected to the skirt portion by frangible ribs, and remains connected to the skirt portion attendant to removal of the closure from a container. To facilitate such removal, the pilfer band includes a fracturable portion. Consistent and reliable performance are promoted by the formation of a stabilizing score in operative association with the fracturable portion of the pilfer band. A method of forming the closure is also disclosed, including the provision of movable scoring blades for effecting scoring of the closure to facilitate high-speed manufacture.

7 Claims, 5 Drawing Figures

TAMPER-INDICATING PLASTIC CLOSURE

TECHNICAL FIELD

The present invention relates generally to a tamper-indicating plastic closure construction for bottles and like containers, and more particularly to a closure construction including a pilfer band arranged to fracture and remain connected to a skirt portion of the closure as the closure is removed from a container.

BACKGROUND OF THE INVENTION

Commonly assigned U.S. Pat. Nos. 4,418,828 and 4,497,765 disclose a tamper-indicating plastic closure construction which has proven to be highly commercially successful in light of the efficiency with which it can be formed, and the consistent and reliable tamper-indicating characteristics which it exhibits. The latter of the above patents discloses a method of making the closure with highly desirable efficiency and consistency.

In particular, the construction includes an annular pilfer band which depends from a skirt portion of a plastic closure cap. The pilfer band includes a plurality of circumferentially spaced, inwardly extending flexible projections which are configured to coact and cooperate with an annular locking ring portion of an associated container. The pilfer band is at least partially detachably connected to the skirt portion of the closure by frangible means preferably comprising a plurality of circumferentially spaced frangible ribs. Attendant to removal of the closure from a container, the flexible projections coact with the locking ring to fracture the frangible ribs, thereby providing plainly visibly discernable evidence that the closure has been partially or completely removed.

In one embodiment of the above-described closure, a connector portion is provided which integrally connects the pilfer band to the skirt portion after fracture of the frangible ribs, whereby the pilfer band remains connected to the closure cap after removal from the container. In this arrangement, the pilfer band is preferably provided with at least one fracturable area which fractures attendant to closure removal. This fracturable area can comprise a score or cut formed in the pilfer band generally adjacent to the connector portion which joins the band to the skirt. After removal from the container, the fractured pilfer band typically takes on a curl-like configuration; as a consequence, this type of closure is sometimes referred to as having a pilfer band which forms a "pigtail".

In order to promote convenient removal of closures of the above type from containers, it is desirable that the pilfer band be configured to fracture without undue application of force thereto. On balance, it is important that premature failure of the pilfer band be avoided so that it reliably indicates closure removal.

As noted, one or more scores can be formed in the closure pilfer band in order to form a fracturable area. More specifically, a vertically extending score can be formed so that a non-scored, residual portion of the pilfer band is defined, which said residual portion fails and fractures attendant to closure removal. While it would appear that a readily fracturable construction can be formed by merely scoring the closure pilfer band to define a sufficiently small residual portion, experience has shown that formation of a residual portion which is sufficiently small as to be easily fractured during closure removal is frequently prone to premature failure during formation of the residual portion itself. In this regard, it has been determined that the cutting edge or edges of the one or more blades employed for forming the fracturable residual portion exert a wedge-like action on the pilfer band during scoring which can result in failure of the residual portion as it is formed. Naturally, this is undesirable since the pilfer band must be intact for use as intended.

Accordingly, it is desirable to provide a closure pilfer band construction, and a method of forming the construction, which avoids premature band failure, while promoting formation of a closure which can be easily and conveniently removed by consumers.

SUMMARY OF THE INVENTION

In accordance with the present invention, a tamper-indicating closure construction is disclosed which has been specifically configured for convenient removal from a container by consumers, while at the same time being subject to efficient, high-speed formation. Briefly summarizing, the present closure construction includes a scoring arrangement for a closure pilfer band which provides a fracturable residual portion in the band at a first location, and an operatively associated stabilizing score at a second circumferentially spaced location, which said stabilizing score is generally horizontally aligned with and spans the residual portion. This stabilizing score is formed generally simultaneously with formation of the residual portion, and desirably acts to avoid premature failure of the residual portion during its formation by scoring of the pilfer band. Additionally, a method for forming the present closure is disclosed, with the method comprising a technique by which the scoring means which cuts and scores the closure pilfer band is moved with the closure during manufacture thereof. Highly accurate, consistent, and efficient formation of tamper-indicating closures results.

The tamper-indicating closure embodying the present invention comprises a plastic closure cap having a top wall portion, and an annular skirt portion which depends from the top wall portion. In the preferred form, the skirt portion is provided with an internal thread formation configured to coact with a like thread formation provided on a container to which the closure is applied.

The present closure further includes an annular pilfer band which depends from the skirt portion of the plastic closure cap, and which is distinguished from the skirt portion by a circumferentially extending score formed between the skirt portion and the pilfer band. This circumferential score is preferably arranged to extend partially into a plurality of circumferentially spaced frangible ribs which extend between the inner surfaces of the pilfer band and the skirt portion. In this manner, a detachable connection is formed between the skirt portion and the pilfer band.

In order for the pilfer band to remain attached to the closure cap as the closure is removed from a container, the circumferential score is preferably discontinuous, and does not extend entirely about the closure. A connector portion is thus defined generally between the ends of the circumferential score, with the connector portion integrally connecting the pilfer band to the closure skirt portion. Thus, the pilfer band is partially detachably connected to the skirt portion in the sense that the principal portion of the pilfer band separates from the skirt portion during closure removal, but the band remains joined to the skirt portion by the connector portion.

In order to promote convenient removal of the pilfer band with the closure cap from the container, the pilfer band includes a fracturable portion. In the preferred form, the fracturable portion comprises a residual portion which is defined by score means which extend vertically of the closure in a direction transversely of the pilfer band. The score means preferably comprises a pair of vertically spaced scores between which the fracturable residual portion is defined.

In accordance with the present invention, the pilfer band further includes a stabilizing score operatively associated with the fracturable residual portion. The stabilizing score is positioned in closely circumferentially spaced relation to the residual portion, and is preferably formed to be generally horizontally aligned with and span the residual portion. In accordance with the method of the present invention, the stabilizing score is preferably formed in the pilfer band substantially simultaneously with the vertically spaced scores which define the residual portion. Significantly, this substantially simultaneous formation of the stabilizing score acts to avoid premature failure of the residual portion as it is formed by the wedge-like action of the scoring blades.

High-speed closure manufacture is promoted by the present method of forming a tamper-indicating closure. During practice of the method, a molded plastic closure having a top wall, a depending skirt, and an annular pilfer band is provided, and is moved relative to a scoring apparatus. The scoring apparatus includes scoring blade means which are engaged with the closure pilfer band for scoring of the band to form a fracturable residual portion. Significantly, the scoring blades are arranged for movement, with the present method including moving the scoring blades with the closure as the closure is moved relative to the scoring apparatus. In the preferred form, a spring-loaded pivotal arm is provided for pivotally movably mounting the scoring blades. Consistent, high-speed closure scoring is achieved by this arrangement.

Numerous other advantages and features of the present invention will become readily apparent from the following detailed description, accompanying drawings, and the appended claims.

DETAILED DESCRIPTION

Figure 1:
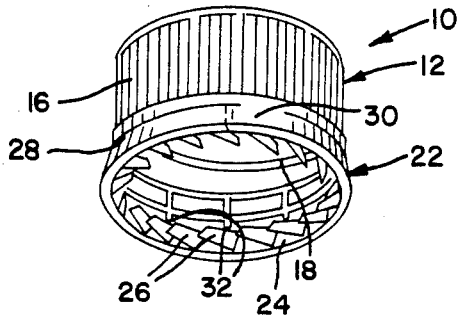
FIG. 1 is a perspective view of a tamper-indicating plastic closure embodying the principles of the present invention.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

Figure 2:
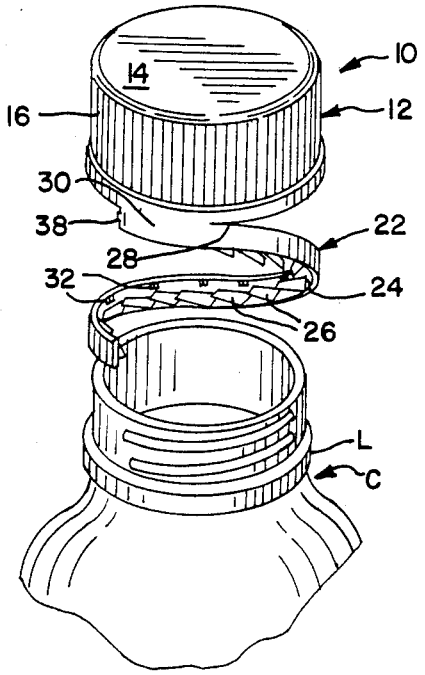
FIG. 2 is a perspective view illustrating the plastic closure of FIG. 1 after it has been removed from an associated container, wherein a pilfer band of the closure has formed a curl-like "pigtail"

Referring first to FIGS. 1 and 2, therein is illustrated a plastic closure 10 embodying the principles of the present invention. Closure 10 can be very efficiently formed in accordance with the teachings of commonly-assigned U.S. Pat. Nos. 4,343,754 and 4,497,765.

Closure 10 includes a cup-like plastic closure cap 12 comprising a top wall portion 14 and an annular skirt portion 16 which depends integrally from the top wall portion 14. The skirt portion 16 is preferably provided with an integral internal thread formation 18 (FIG. 1) which is adapted to mate with a like thread formation on a bottle or like container C to which the closure is applied. The exterior of the skirt portion 16 is preferably provided with axially extending finger grips to promote convenient use by consumers.

Closure 10 desirably includes an annular pilfer band 22 which is arranged to coact with an annular locking ring L on container C during closure removal to provide readily visually discernable evidence that the closure has been removed from the container. Closure 10 is illustrated as including a pilfer band configured in accordance with commonly-assigned U.S. Pat. No. 4,418,828. In this regard, the pilfer band 22 includes an annular band portion 24, and a plurality of circumferentially spaced, relatively flexible wing-like projections 26 which extend integrally inwardly from the band portion 24. Projections 26 are configured to engage and coact with locking ring L on container C attendant to removal of closure 10 therefrom in order to partially detach pilfer band 22 from skirt portion 16.

The partial detachable connection between pilfer band 22 and skirt portion 16 is provided by a circumferential score 28 formed between and distinguishing pilfer band 22 from skirt portion 16. In a closure of the present type wherein pilfer band 22 is intended to remain partially connected to closure cap 12 after closure removal, circumferential score 28 is discontinuous in the sense that it does not extend completely about closure 10. Rather, score 28 extends substantially completely about closure 10, with an unscored portion of the closure between the ends of the score 28 providing a connector portion 30 which integrally connects pilfer band 22 to the skirt portion 16.

The pilfer band is otherwise detachably connected to the skirt portion by a plurality of circumferentially spaced frangible ribs 32 which extend vertically between the inside surfaces of band portion 24 and skirt portion 16. Circumferential score 28 preferably extends inwardly into the ribs 32 whereby the ribs are frangible, and fracture attendant to closure removal for tamper-indication (note that the portions of fractured ribs 32 provided on pilfer band 22 are visible in FIG. 2 which illustrates the closure 10 after removal, with the pilfer band 22 partially detached from skirt portion 16).

Figure 3:
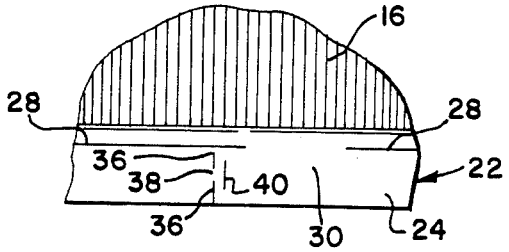
FIG. 3 is a relatively enlarged, fragmentary side elevational view illustrating a scoring arrangement for the closure pilfer band whereby the pilfer band is fracturable.

In order to promote convenient removal of closure 10 from container C, including the partial detachment of pilfer band 22 from skirt portion 16, pilfer band 22 is preferably formed with a fracturable portion which fails or fractures as the closure is removed from the container. In accordance with the present invention, pilfer band 22 is provided with fracturable means comprising the provision of a pair of vertically spaced, vertically extending scores 36 between which is defined a non-scored, fracturable residual portion 38 (see FIG. 3). Residual portion 38 is preferably formed in the pilfer band 22 to be generally circumferentially adjacent to connector portion 30, whereby upon failure of portion 38 during closure removal, pilfer band 22 assumes a curl-like, "pigtail" configuration, as illustrated in FIG. 2.

It is presently preferred that a further non-scored, fracturable residual portion be formed between the upper one of scores 36 and the circumferential score 28. This further residual portion (shown in FIG. 3, but unnumbered) desirably acts to stabilize the pilfer band 22, and prevent the pilfer band from twisting or turning about the residual portion 38. In other words, this further unscored portion prevents the portion of band 22 to the left of scores 36 (referring to the orientation of FIG. 3) from twisting about residual 38 such that the upper edge of this band portion moves outwardly while the lower edge moves inwardly.

During development of the present invention, attempts were made to perfect a construction employing scoring at but a single circumferential location in the pilfer band 22, i.e., such as by a pair of vertically spaced scores 36 defining one or more residual portions. However, it was recognized that consistent formation of a residual portion such as 38 was very difficult since the wedge-like action of the notched cutting blade employed for forming scores 36 acted to tear the residual portion 38 during formation thereof.

It was then recognized that highly desirable consistency could be achieved by stabilizing the residual portion 38 during its formation. More specifically, it was found that when another score was formed substantially simultaneously at a closely circumferentially spaced location on the band 22, highly consistent formation of a fracturable residual portion 38 could be achieved. In practice, the formation of a stabilizing score 40 is preferred. Stabilizing score 40 is preferably configured to be generally horizontally aligned with, and to generally span residual portion 38. Further, formation of stabilizing score 40 substantially simultaneously with, but preferably just before, formation of scores 36 best-resulted in very consistent and accurate formation of fracturable residual portion 38.

The present scoring arrangement for pilfer band 22 is preferably configured in accordance with the following parameters. The dimension between stabilizing score 40 and circumferential score 28 is sufficiently greater than the spacing between upper score 36 and score 28 to assure that the band always fails at the unscored residual region between upper score 36 and score 28. The dimension between the lower end of stabilizing score 40 and the edge of band 22 is preferably sufficiently large to avoid tearing between the score 40 and the edge of the band by the scoring blade which forms score 40.

The length of stabilizing score 40 is sufficient to support and stabilize the non-scored fracturable portion 38 as it is formed, with the portion 38 and the further residual between upper score 36 and score 28 being the only areas affecting closure removal. In current practice, spacing between stabilizing score 40 and residual portion 38 on the order of 0.030–0.040 inches has provided the desired stabilizing effect. Essentially, the desired goal of the present invention is to provide a minimal non-scored fracturable area for ease of closure removal, while still providing a closure which is sufficiently strong to avoid failure attendant to high-speed closure printing and container capping.

Figure 4:
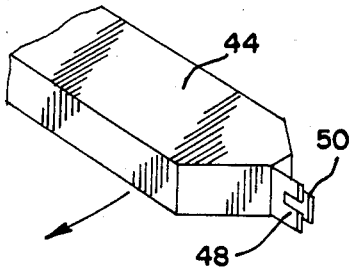
FIG. 4 is a fragmentary perspective view of a scoring blade arrangement particularly suited for forming the pilfer band scoring arrangement shown in FIG. 3.
Figure 5:
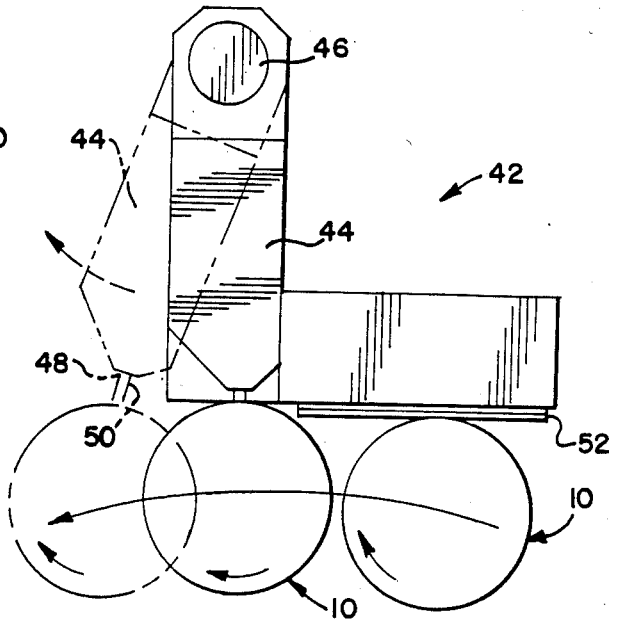
FIG. 5 is a top plan diagrammatic view illustrating use of the scoring blade arrangement shown in FIG. 4 for practicing the present method of scoring a plastic closure.

A preferred method for forming a closure in accordance with the present invention will now be described. FIGS. 4 and 5 diagrammatically illustrate a scoring apparatus 42 which is employed for high-speed formation of circumferential score 28, vertically spaced scores 36, and stabilizing score 40 in plastic closure 10. In the preferred practice, closures 12 are moved relative to scoring apparatus 42 by suitable conveyor means (not shown). Preferably, the closures 10 are not only moved in a generally arcuate path relative to the scoring apparatus, each closure is further moved by rotation about its own axis as indicated by the arrows in FIG. 5. During scoring, the closures 10 are oriented with their top wall portion facing downwardly (i.e., the pilfer band 22 of each closure defines its "upper" edge).

In order to form the fracturable area in pilfer band 22 of each closure, scoring apparatus 42 includes a pivotally movable support arm 44, pivotally mounted on a suitable pivot 46, which is arranged for spring-biased movement from the position shown in solid line in FIG. 5 generally to the position shown in phantom line. Spring-biasing is preferably provided to urge the support arm 44 toward the position shown in solid line.

A pair of cutting blades 48 and 50 are provided on the support arm 44, and are thus movable therewith. As will be appreciated, the illustrated notched cutting blade 48 is configured to form vertically spaced scores 36, while the scoring blade 50 is arranged to form stabilizing score 40. In the preferred form, cutting apparatus 42 is further provided with a horizontally arranged scoring blade 52 which forms circumferential score 28 in closure 10.

The scoring action of the apparatus 42 will thus be readily appreciated. As a closure 10 is moved relative to the scoring apparatus, the closure is engaged by scoring blade 52 and score 28 and connector portion 30 are formed. Immediately thereafter, the closure engages scoring blades 48 and 50, with the closure engaging blades 48 and 50 substantially simultaneously, but preferably with blade 50 engaging first. As the scoring blades 48 and 50 cut pilfer band 22 (preferably substantially completely through annular band portion 24), the continued movement of the closure acts to move support arm 44 (and thus blades 48 and 50) against the action of the support arm's biasing spring. The continued movement of the closure relative to the scoring apparatus effects disengagement of the blades 48 and 50 from the closure, whereupon support arm 44 returns to its initial position for scoring of the next following closure. In a sense, this cooperative action of the movable scoring blades 48 and 50 and each closure is somewhat akin to the unmeshing action of gear teeth of adjacent spur gears, with the scoring blades 48 and 50 moved at a rate corresponding to the peripheral speed of each closure. Accurate and high-speed formation of the desired scores in pilfer band 22 is greatly facilitated by this forming method.

From the foregoing, it will be observed that numerous modifications and variations can be effected without departing from the true spirit and scope of the novel concept of the present invention. Accordingly, no limitation with respect to the specific embodiment of the invention disclosed herein is intended or should be inferred. Rather, it is intended to cover all such modifications and variations of the invention as fall within the scope of the appended claims.

What is claimed is:

1. A tamper-indicating closure, comprising:

a plastic cap having a top wall portion and a depending annular skirt portion;

an annular pilfer band depending from said skirt portion and being partially detachably connected thereto by frangible means, said pilfer band including a fracturable residual poriton defined by score means extending in a direction transversely of said pilfer band, said pilfer band further including stabilizing means operatively associated with said fracturable residual portion for preventing premature failure of said fracturable residual portion, said stabilizing means comprising further score means in said pilfer band positioned in closely spaced relation to said residual portion.

2. A tamper-indicating closure in accordance with claim 1, wherein the first-said score means comprises a pair of spaced apart scores extending transversely of said pilfer band and between which said residual portion is defined, said stabilizing means comprising said further score being circumferentially spaced from and generally horizontally aligned with and spanning said residual portion.

3. A tamper-indicating closure in accordance with claim 1, wherein said closure includes a connector portion integrally joining said pilfer band and said skirt portion whereby said pilfer band remains attached to said skirt portion after fracture of said frangible means.

4. A tamper-indicating closure in accordance with claim 3, wherein said residual portion of said pilfer band is positioned generally circumferentially adjacent to said connector portion.

5. A tamper-indicating closure in accordance with claim 3 wherein said closure includes circumferentially extending score means extending between said skirt portion and said pilfer band, said circumferential score means being discontinuous and thereby defining said connector portion.

6. A tamper-indicating closure, comprising:

a plastic cap having a top wall portion and a depending annular skirt portion having an internal thread formation; and an annular pilfer band depending from said skirt portion and being distinguished therefrom by circumferential score means which define a connector portion integrally connecting said pilfer band and skirt portion, said pilfer band being otherwise detachably connected to said skirt portion by frangible means, said pilfer band including fracturable means comprising a residual portion of said pilfer band which is defined by a pair of vertically spaced, vertically extending scores formed in said pilfer band, said pilfer band further including stabilizing means comprising a further stabilizing vertical score positioned in closely circumferentially spaced relation to said residual portion, said stabilizing score being generally horizontally aligned with and spanning said residual portion for preventing premature failure of said residual portion.

7. A tamper-indicating closure in accordance with claim 6, wherein said fracturable means of said pilfer band is positioned generally circumferentially adjacent to said connector portion integrally connecting said pilfer band and said skirt portion.

* * * * *